US006050592A

United States Patent [19]

Kim

[11] Patent Number: 6,050,592

[45] Date of Patent: Apr. 18, 2000

[54] COMBINED GOLF BAG AND COLLAPSIBLE GOLF CART

[76] Inventor: Hyung Ho Kim, 25-11 Nunterspoint Ave., 2nd floor, Long Island City, N.Y. 11101

[21] Appl. No.: 09/046,205

[22] Filed: Mar. 23, 1998

[51] Int. Cl.[7] ..... B62B 1/20

[52] U.S. Cl. ..... 280/652; 280/35; 280/47.131; 280/47.17; 280/639; 280/645; 280/646; 280/DIG. 6

[58] Field of Search ..... 280/47.131, 47.17, 280/47.26, 35, 79.2, 639, 651, 652, 654, 659, 645, 646, 647, 650, DIG. 6, 642, 648, 638; 403/112, 113, 116

[56] References Cited

U.S. PATENT DOCUMENTS

| | | | |
|---|---|---|---|
| 1,762,580 | 6/1930 | Menk | 403/116 |
| 1,787,167 | 12/1930 | Purdy | 403/116 |
| 4,053,169 | 10/1977 | Taylor | 280/37 |
| 4,832,361 | 5/1989 | Nakao et al. | 280/642 |
| 4,872,692 | 10/1989 | Steenburg | 280/30 |
| 4,887,835 | 12/1989 | Dallaire et al. | 280/646 |
| 4,890,856 | 1/1990 | Mursch et al. | 280/646 |
| 5,074,577 | 12/1991 | Kim | 280/646 |
| 5,409,253 | 4/1995 | Cheng | 280/646 |
| 5,451,072 | 9/1995 | Weng | 280/646 |
| 5,478,097 | 12/1995 | Forma | 280/47.26 |
| 5,857,684 | 1/1999 | Liao et al. | 280/40 |

FOREIGN PATENT DOCUMENTS

| | | | |
|---|---|---|---|
| 1172525 | 12/1969 | United Kingdom | 280/646 |

*Primary Examiner*—Eric Culbreth
*Assistant Examiner*—L. Lum
*Attorney, Agent, or Firm*—Michael I. Kroll

[57] ABSTRACT

A combined golf bag and collapsible golf cart (10) comprising a golf bag assembly (12) for holding various golf clubs and supplies. A golf cart assembly (14) is permanently built into the golf bag assembly (12). A structure (16) is for moving the golf cart assembly (14) from a retracted position in which the golf cart assembly (14) nests against the golf bag assembly (12) to an extended position away from the golf bag assembly (12), so that the golf bag assembly (12) can be transported by the golf cart assembly (14) along the ground.

8 Claims, 9 Drawing Sheets

COMBINED GOLF BAG AND COLLAPSIBLE GOLF CART

BACKGROUND OF THE INVENTION

1. Field of the Invention

The instant invention relates generally to golf equipment and more specifically it relates to a combined golf bag and collapsible golf cart. The combined golf bag and collapsible golf cart is a golf cart assembly that is built into a golf bag assembly, so that operation of a hand switch on a pull handle makes it simple to change carrying the golf bag assembly from a hand pull golf cart mode to a carry on shoulder golf bag mode. The golfer can save time in utilizing and storing the golf cart assembly, since the golf bag assembly and the golf cart assembly are combined into one unit, so that the golfer can transport the golf bag assembly any place on the playing field.

2. Description of the Prior Art

Numerous golf equipment have been provided in prior art. For example, U.S. Pat. Nos. 3,014,732 to Schemenauer; 4,053,169 to Taylor; 4,382,612 to Larkin; 4,522,299 to Clark et al.; 4,822,071 to Widegren; 4,890,856 to Mursch et al.; 4,911,465 to Hauer; 5,267,750 to Thompson and 5,470,095 to Bridges all are illustrative of such prior art. While these units may be suitable for the particular purpose to which they address, they would not be as suitable for the purposes of the present invention as heretofore described.

SCHEMENAUER, HAROLD L.

GOLF CLUB CARRIER

U.S. Pat. No. 3,014,732

A golf club carrier comprising wall means forming at least one elongated receptacle arrange in U-shaped configuration and a lower, wheel-receiving recess having a lower, open end. A collapsible undercarriage includes a pair of wheels. A pair of supporting struts are rotatably connected to the wheels. A connecting plate to which the supporting struts are pivotally attached is for movement between an extended position with the struts diverging and a closed position with the struts adjacent one another. Means is for pivotally attaching the plate relative to the wall means at a location intermediate upper and lower edges of the wall means. This enables the plate to swing in a plane perpendicular to the plane of movement of the struts between the closed and extended positions, to move the struts between an outer position with the wheels spaced from the wall means and a retracted position with at least a substantial portion of the struts and a substantial portion of the wheels substantially within the open end recess defined by the wall means with the wheels extending there below to provide support even when in their closed position.

TAYLOR, CLARENCE R.

COMBINED GOLF BAG AND CART MECHANISM

U.S. Pat. No. 4,053,169

A combined golf bag and cart mechanism in which the bag and cart are permanently coupled to one another. The bag provides a rigid support for the cart and is provided with a cavity. The cart is movable between a retracted position in which the cart wholly nests within the cavity, and an extended position in which the cart support the bag for transport. The cart has a pair of substantially elliptically shaped wheels, and an orienting device for maintaining the wheels in planes parallel to the axis of the cavity in both the retracted and extended positions of the cart.

LARKIN, SAM

ROLLABLE GOLF BAG

U.S. Pat. No. 4,382,612

A rollable golf bag having an elongated golf bag container with a collapsible rolling assembly coupled to the container. The collapsible rolling assembly is movable between an extended position to permit rolling of the container, and a folded position to facilitate carrying of the container. Wheels connected on the rolling assembly are detachable and can be stored within a storage compartment of the container.

CLARK, GEORGE W.

KEENE, CHRISTOPHER B.

RIGID POLYETHYLENE CARRY GOLF BAG WITH STAND

U.S. Pat. No. 4,522,299

A golf club bag having an integral outer shell. A top panel closes the upper end of the shell, with shaft apertures therein. A core within the shell, stops at the lower end of the core. Guide channels in the core form handle recesses. A handle is on the exterior of the shell. A releasable closure is for the upper end of the shell.

WIDEGREN, JOHN C.

GOLF BAG UNIT HAVING EXTENDABLE AND RETRACTABLE TRAVELLING WHEELS

U.S. Pat. No. 4,822,071

A golf bag unit has extendable and retractable travelling wheels and comprises a tubular body carrying a mounting device, to which is pivotally attached a pair of support legs, each with a travelling wheel. A bag of flexible material coaxially surrounds the tubular body and has a bottom support plate for golf clubs. A pair of link arms pivotally connect with an actuation sleeve member, which is slideably movable on the tubular body. A compression spring is connected with the sleeve member. A control rod provides for a manual compression of the compression spring during retraction of the wheel-carrying support legs and a subsequent automatic extension of the legs to the travelling position. A support ring and a ground support foot is also provided. For facilitating the choice of the various golf clubs in the bag and for reducing the wear of the bottom of the bag, the invention suggests that the support plate of the bag is arranged freely slideably movable on the tubular body between two positions.

MURSCH, MICHAEL

SCHWAIGER, KARL-HEINZ

GOLF CART

U.S. Pat. No. 4,890,856

A golf cart has an undercarriage for receiving a bag, a foldable center pole hinged to the undercarriage, and two legs which can be swung in toward the bag and are hinged to the undercarriage, the legs moving apart downwardly in swung-out position and carrying running wheels which are parallel both in swung-out and swung-in position. The wheels, in the swung-in position, laterally flank the bag and have their bottoms flush with the base of the bag, the wheels projecting beyond the front side of the bag, the center pole being located at the front of the bag.

HAUER, HAROLD J.

GOLF CLUB CONTAINER WITH EXTENSIBLE WHEELS

U.S. Pat. No. 4,911,465

A rigid container for golf clubs and accessories provides two spaced cylindrical compartments interconnected in their end parts to define a medial channel therebetween for containment of retracted wheel structures. The cylindrical compartments provide plural support tubes, each to carry a golf club in frictional engagement for positional maintenance. Foldable wheel structure carried in the medial channel extends therefrom to an operative position to provide means for wheeled locomotion and semi-vertical container support on an underlying surface. The container is covered by a traditional fabric bag.

THOMPSON, MICHAEL R.

MOBILE CART

U.S. Pat. No. 5,267,750

A mobile cart including a wheel mechanism and a handle mechanism attachable to a specially designed container for golf clubs and accessories, or attachable to a specially designed golf club container receiving bracket where the wheel mechanism and handle extends to provide for semi-upright support and wheeled locomotion of the cart. The wheel mechanism provides a means for collapsing one wheel from its operating position toward the top or open end of the container and the other wheel toward the bottom or closed end of the container and where each wheel when collapsed is adjacent and approximately parallel to an elongated wall of the bag. The handle collapses from its operating position to a collapsed position internal to or adjacent to the container. The club container includes upper and lower elements attachable to the ends of elongated support tubes which are covered by a fabric to form a bag.

BRIDGES, JAMES E.

TRANSPORTABLE GOLF BAG

U.S. Pat. No. 5,470,095

A transportable golf bag is disclosed which comprises a pair of deployable wheel assemblies attached to the lower portion of a semi-rigid golf bag. The bag forms the structure of the device without requiring a separate frame or chassis. The wheel assemblies can be locked in a deployed or stored position. The stowed wheels are covered by a closable pocket. A deployable handle for pulling the bag, and a deployable leg for supporting the bag in an upright position can be stowed when not in use.

SUMMARY OF THE INVENTION

A primary object of the present invention is to provide a combined golf bag and collapsible golf cart that will overcome the shortcomings of the prior art devices.

Another object is to provide a combined golf bag and collapsible golf cart in which a golf cart assembly is built into a golf bag assembly, so that operation of a hand switch on a pull handle makes it simple to change carrying the golf bag assembly from a hand pull golf cart mode to a carry on shoulder golf bag mode.

An additional object is to provide a combined golf bag and collapsible golf cart in which the golfer can save time in utilizing and storing the golf cart assembly, since the golf bag assembly and the golf cart assembly are combined into one unit, so that the golfer can transport the golf bag assembly to any place on the playing field.

A further object is to provide a combined golf bag and collapsible golf cart that is simple and easy to use.

A still further object is to provide a combined golf bag and collapsible golf cart that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DESCRIPTION OF THE PREFERRED EMBODIMENTS

Figure 1:
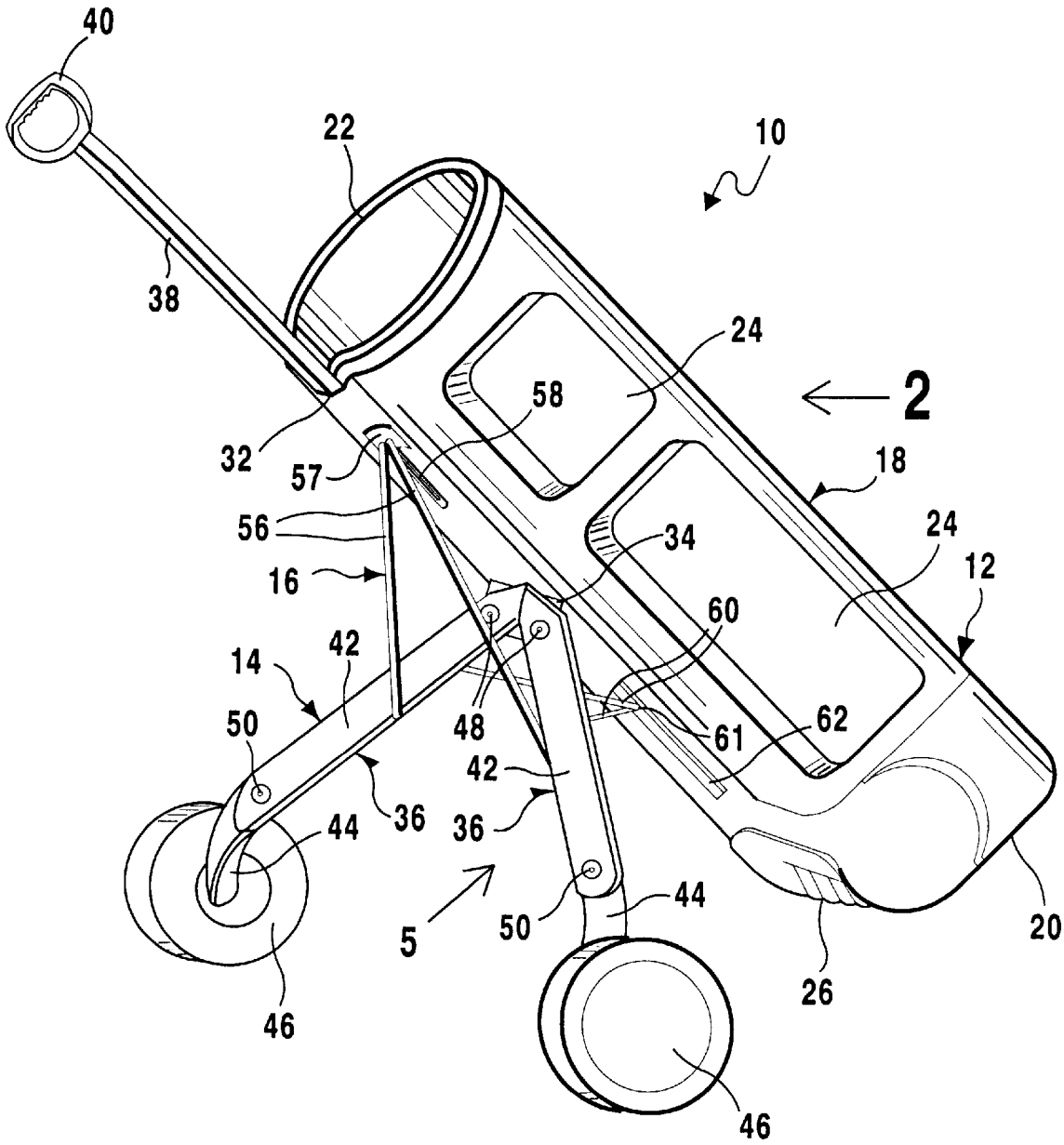
FIG. 1 is a perspective view of the present invention with the golf cart assembly in an extended position.
Figure 2:
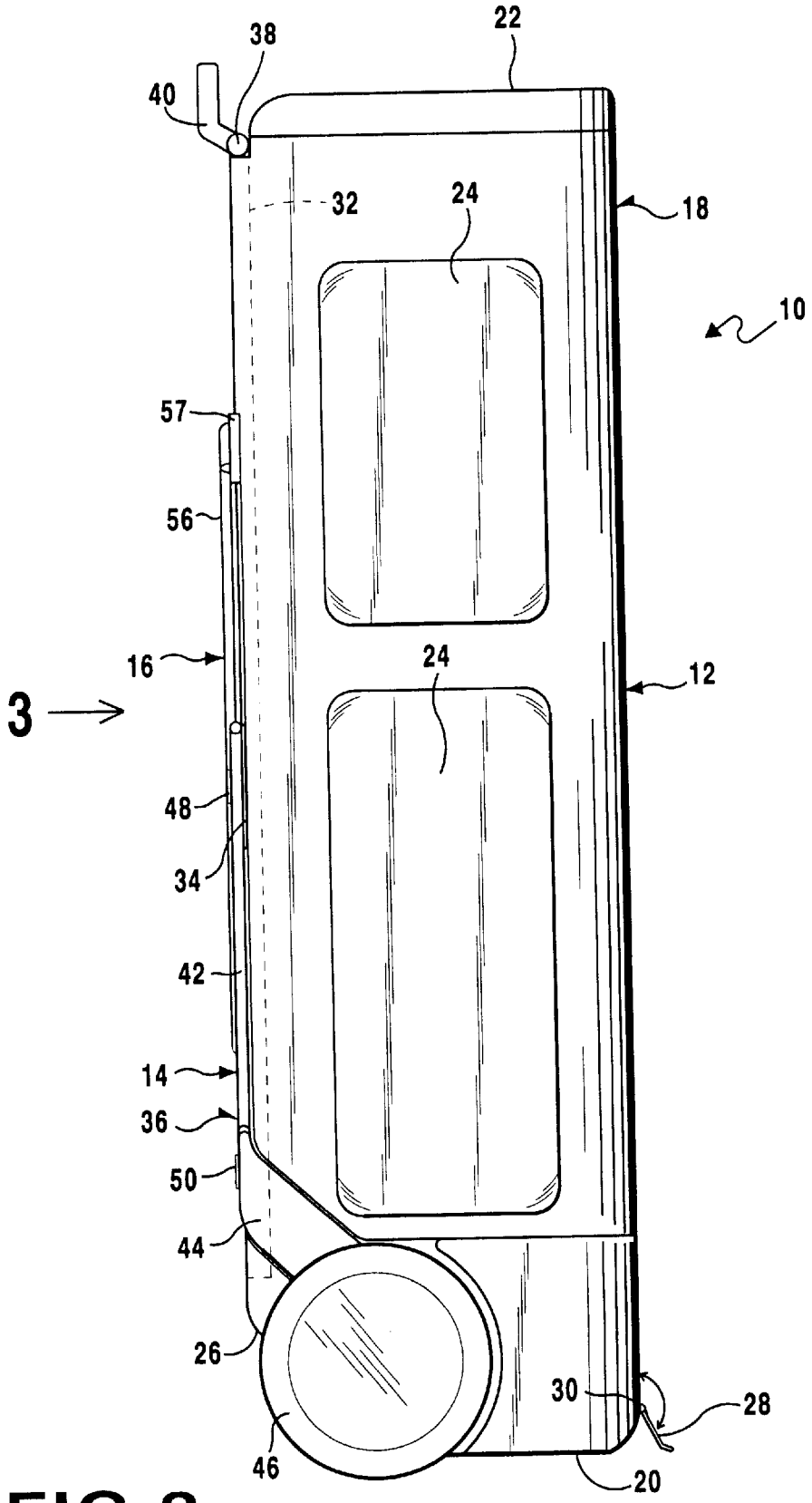
FIG. 2 is a side elevational view taken in the direction of arrow 2 in FIG. 1, with the golf cart assembly in a retracted position.
Figure 3:
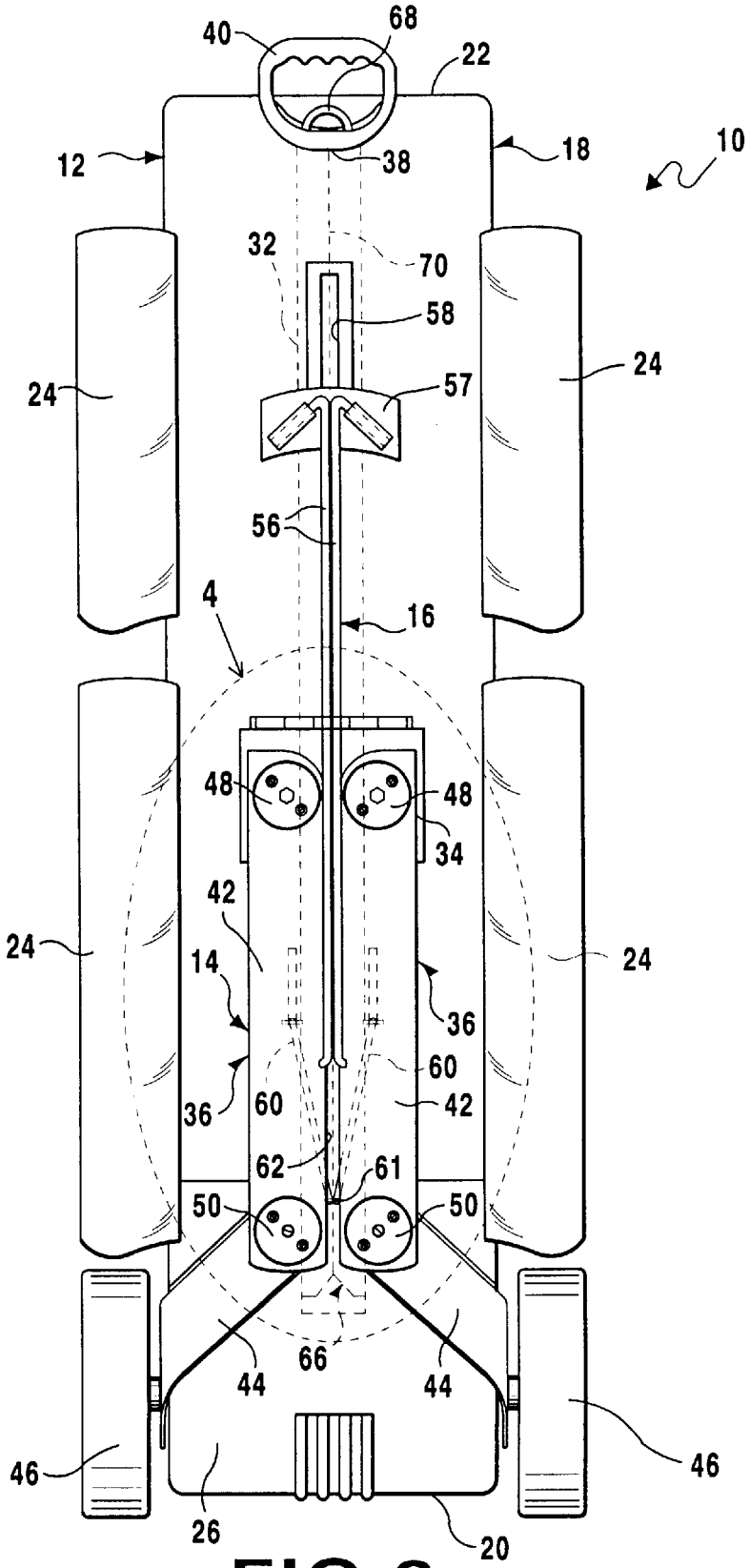
FIG. 3 is a front elevational view taken in the direction of arrow 3 in FIG. 2.
Figure 4:
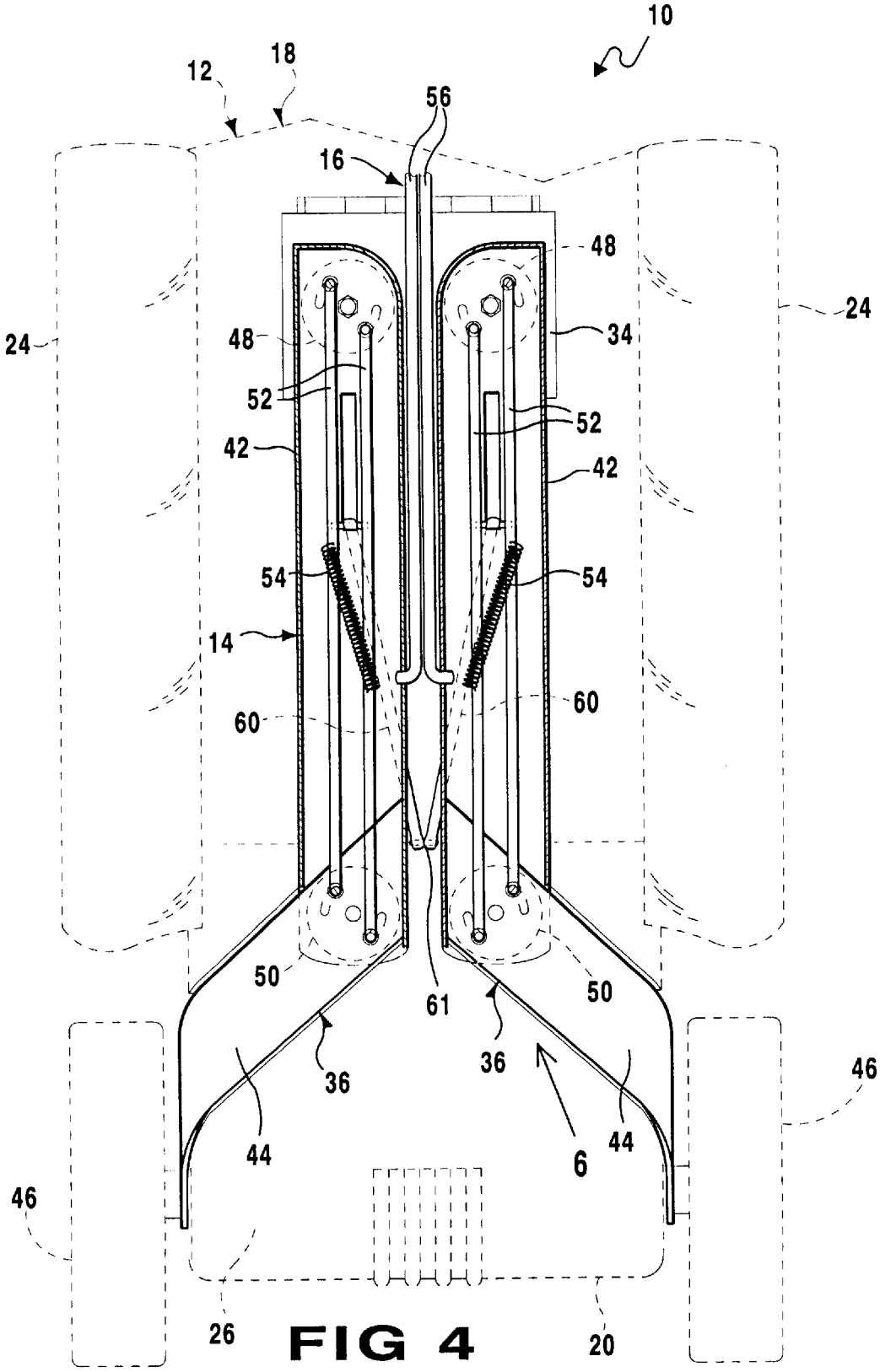
FIG. 4 is an enlarged front partial cross sectional view with parts shown in phantom, as indicated by arrow 4 in FIG. 3.
Figure 5:
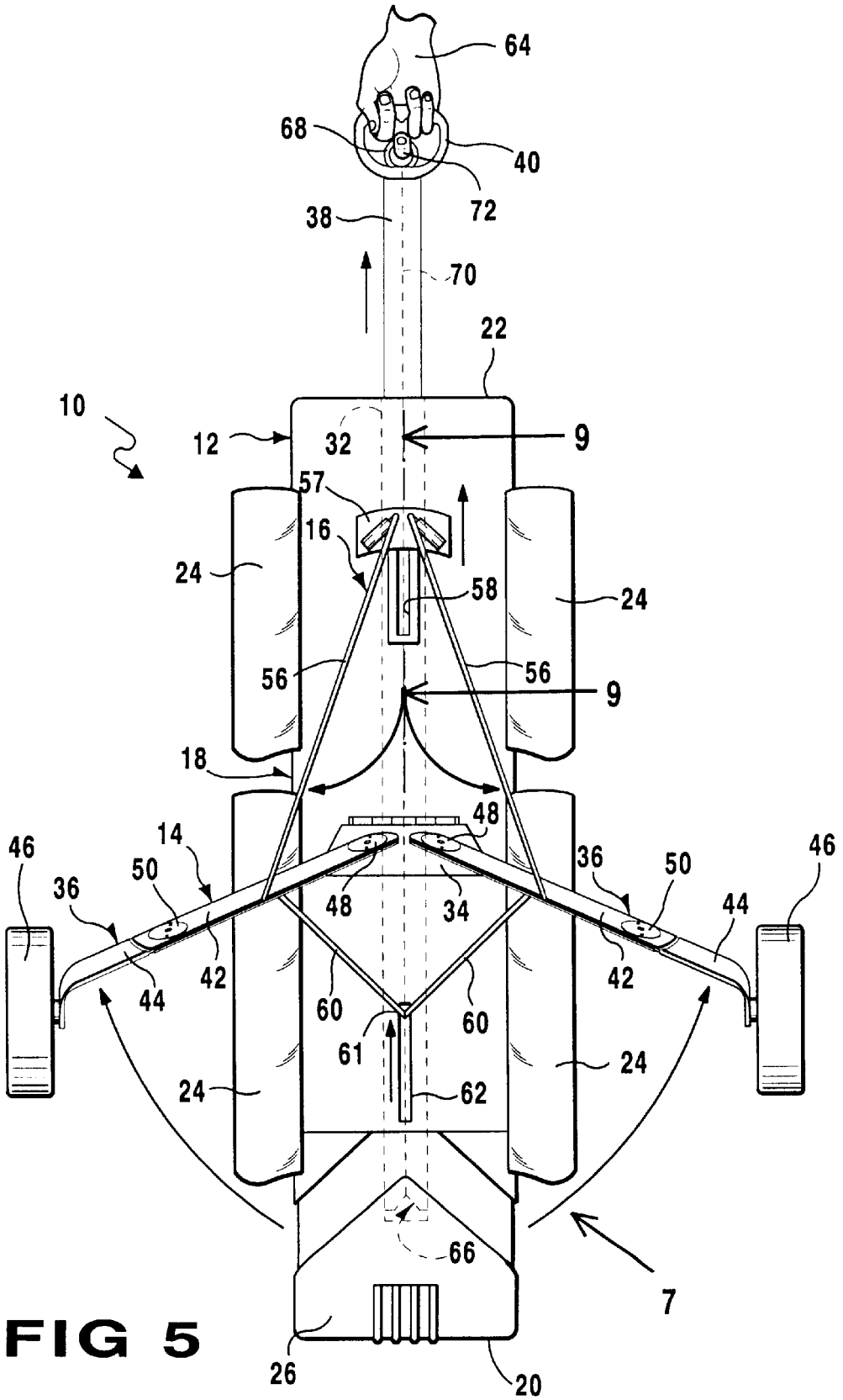
FIG. 5 is a front elevational view taken in the direction of arrow 5 in FIG. 1.
Figure 6:
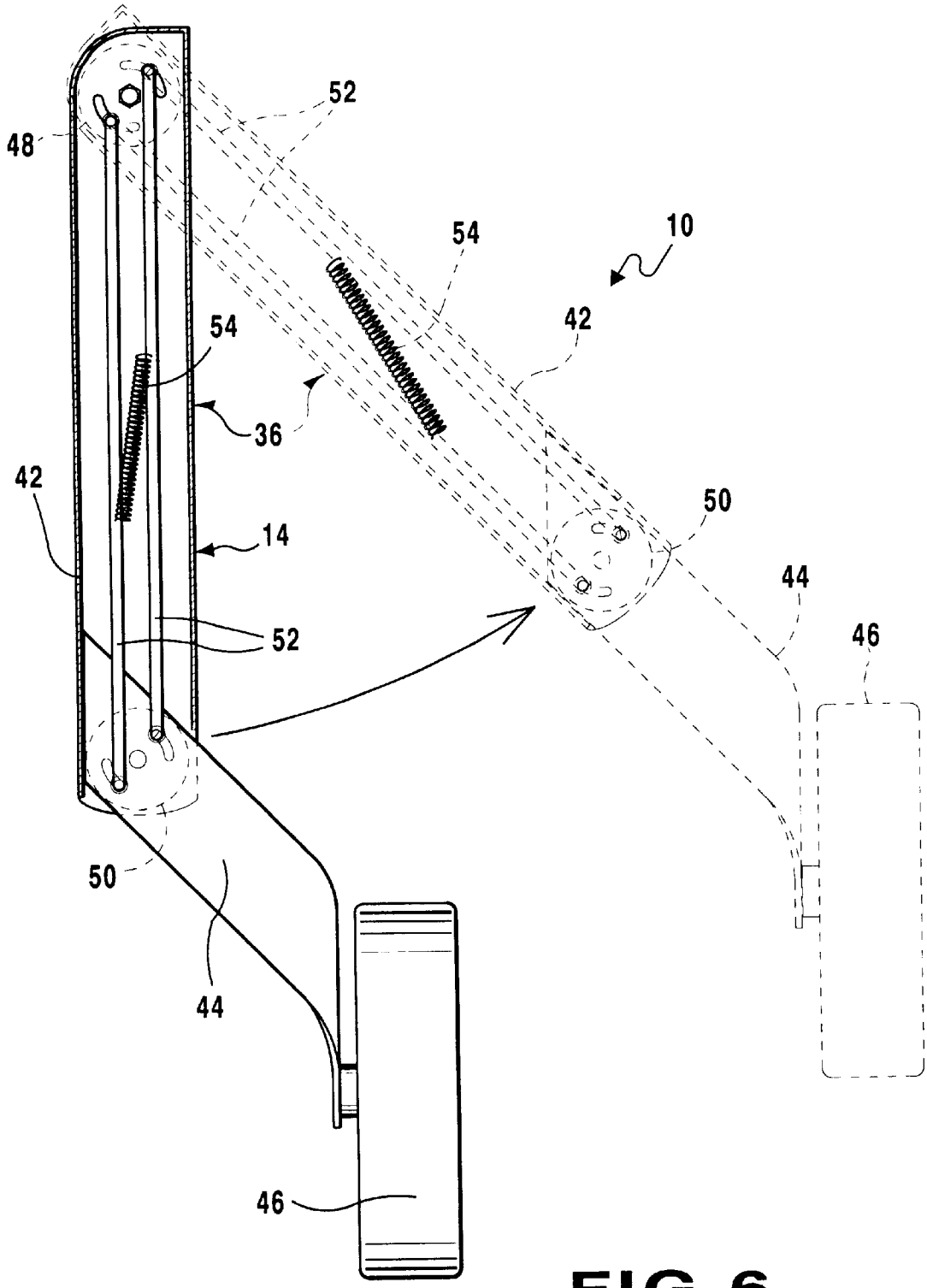
FIG. 6 is a front partial cross sectional view of a portion of the golf cart assembly, as indicated by arrow 6 in FIG. 4, in the retracted position and in the extended position, shown in phantom.
Figure 7:
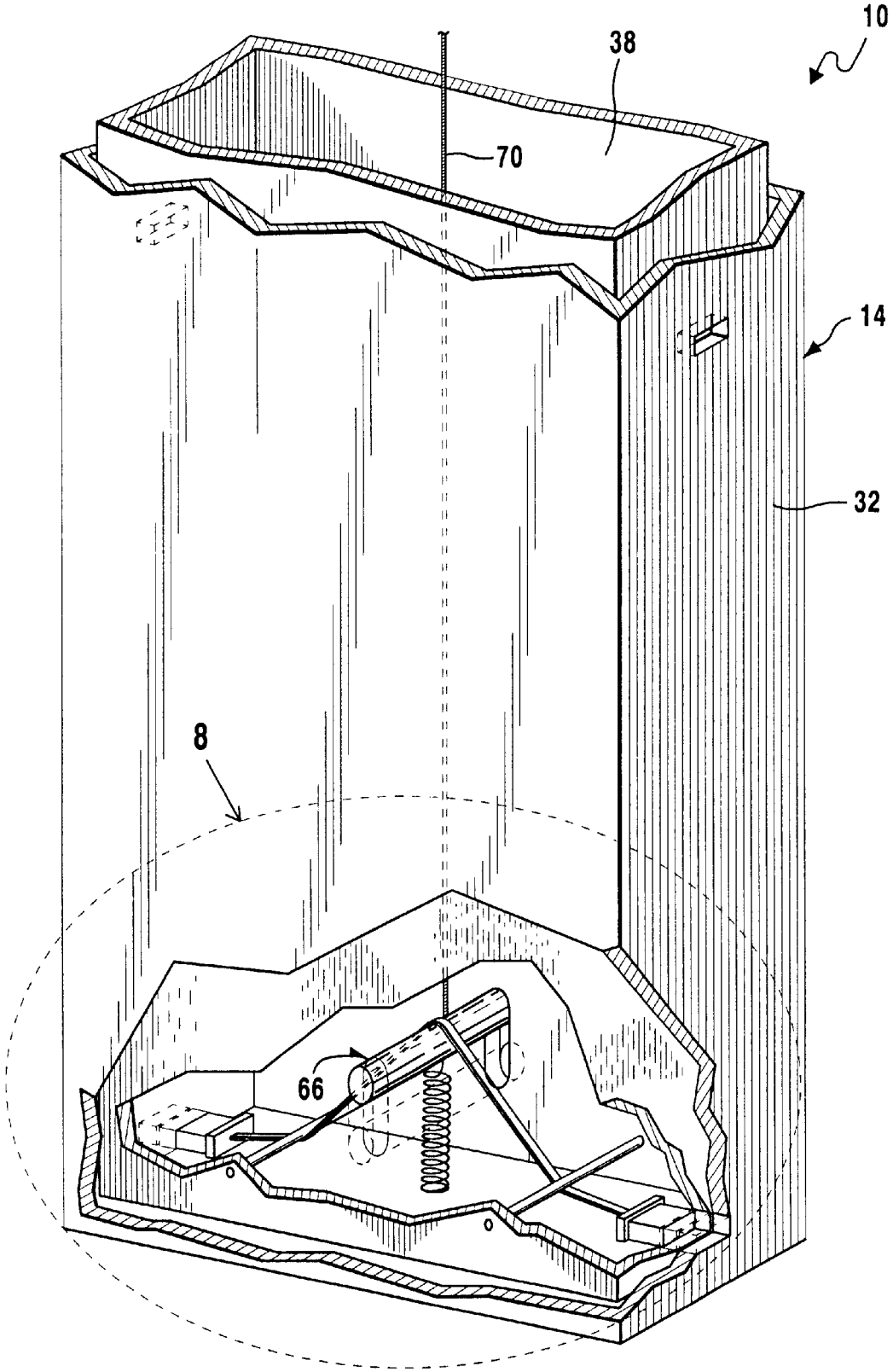
FIG. 7 is an enlarged cutaway perspective view taken in the direction of arrow 7 in FIG. 5, showing the locking mechanism therein.
Figure 8:
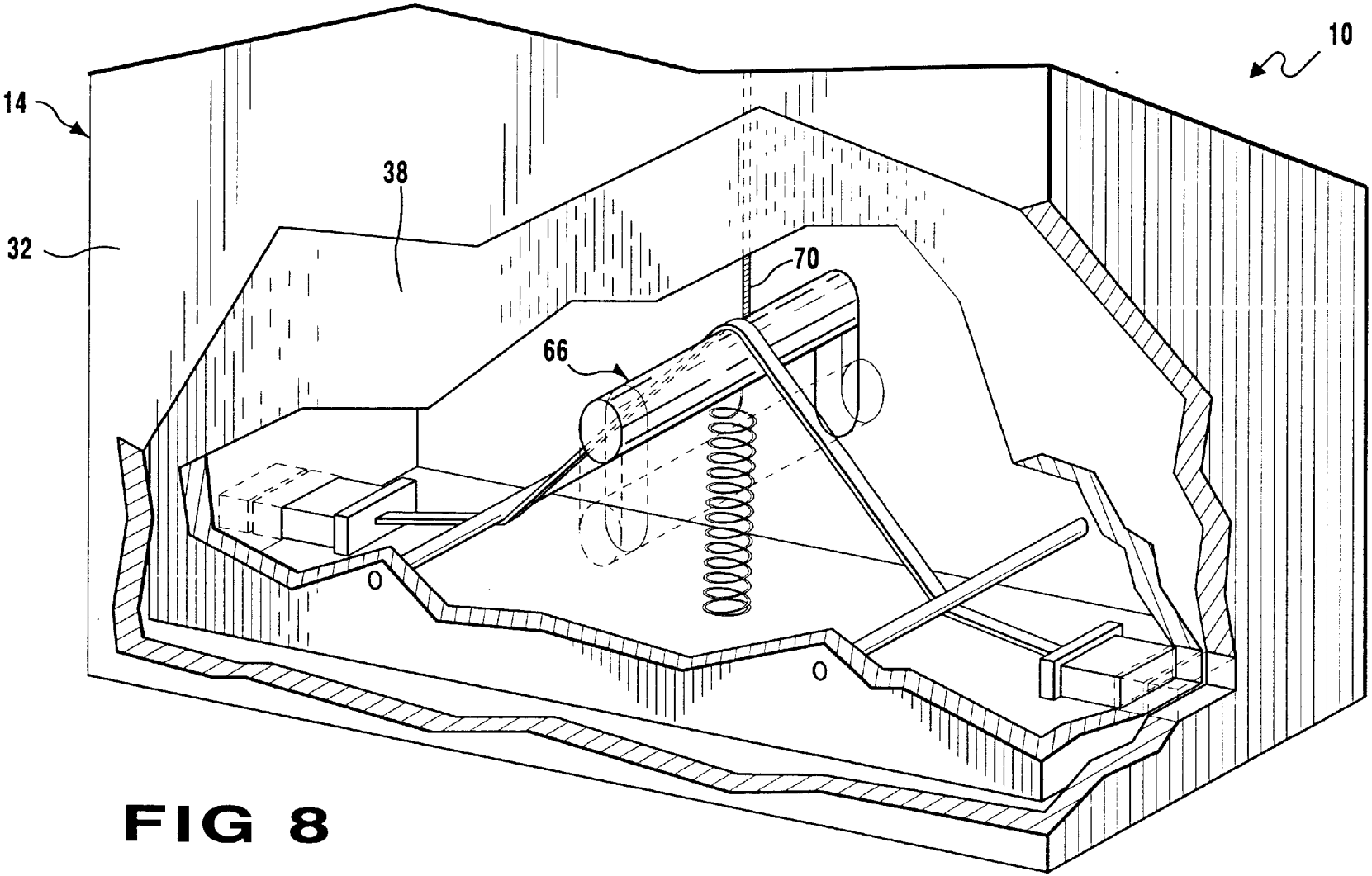
FIG. 8 is a further enlarged cutaway perspective view as indicated by arrow 8 in FIG. 7, showing the locking mechanism in greater detail.
Figure 9:
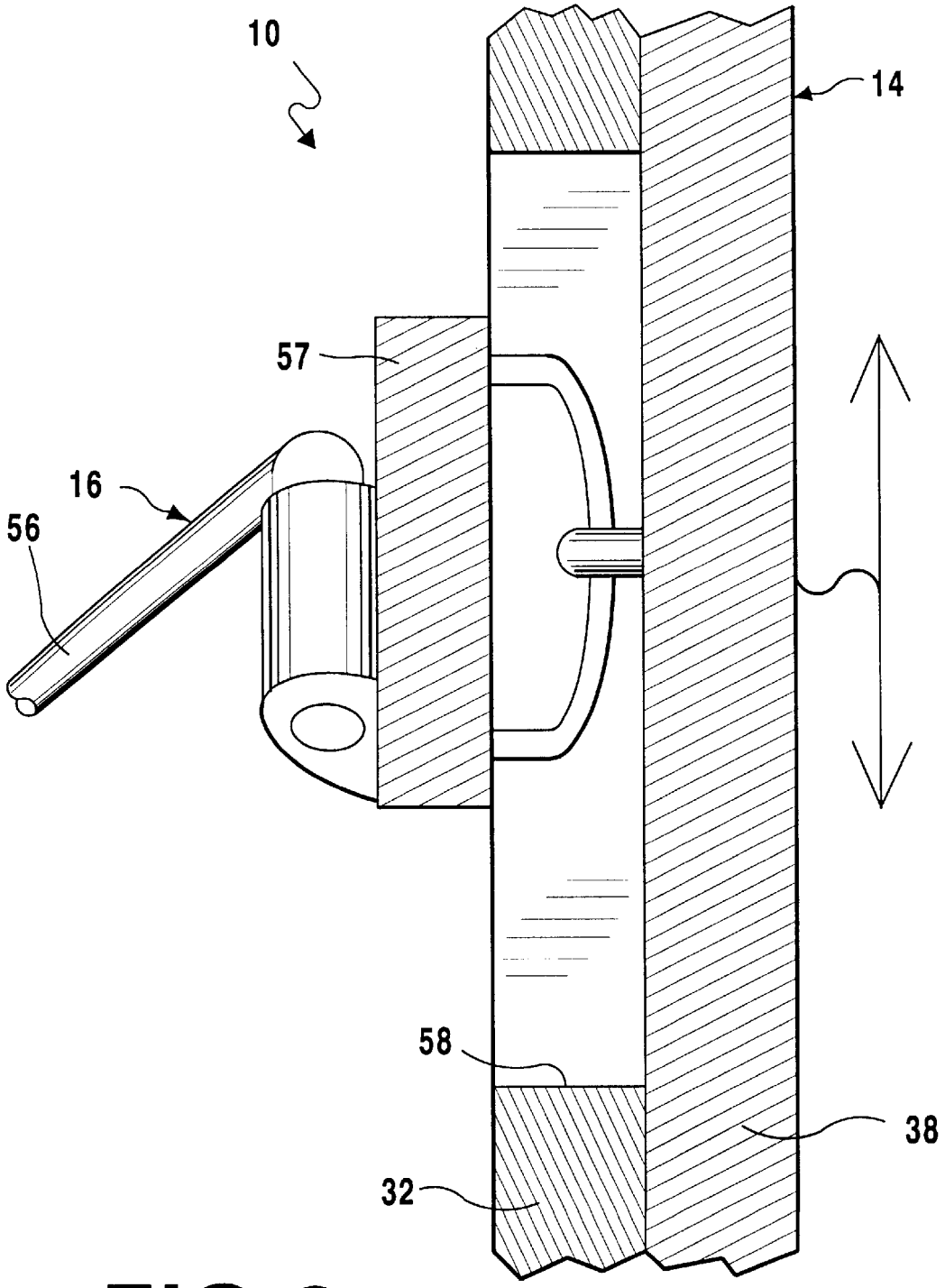
FIG. 9 is an enlarged cross sectional view of the top portion of the upper support mechanism taken along line 9—9 in FIG. 5.

Turning now descriptively to the drawings, in which similar reference characters denote similar elements throughout the several views, FIGS. 1 through 9 illustrate the present invention being a combined golf bag and collapsible golf cart 10. With regard to the reference numerals used, the following numbering is used throughout the various drawing figures.

10 combined golf bag and collapsible golf cart
12 golf bag assembly of 10
14 golf cart assembly of 10
16 moving structure of 10
18 semi-rigid tubular shell of 12
20 closed bottom end of 18
22 open top end of 18
24 side pocket of 12
26 slanted area at 20
28 support leg at 20
30 pivot for 28
32 rigid elongated sleeve member of 14
34 spring loaded hinge plate of 14
36 tubular wheel mechanism of 14
38 handlebar of 14
40 pull handle on 38
42 upper leg channel of 36
44 curved lower leg plate of 36
46 wheel of 36
48 upper pivot joint disc of 42
50 lower pivot joint disc of 42
52 linkage bar of 42
54 tension spring of 42
56 upper support rod of 16
57 upper slide anchor of 16
58 upper track in 32
60 lower support rod of 16
62 lower track in 32
64 hand
66 locking mechanism of 16
68 lock release ring of 16
70 elongated cable of 16
72 finger of 64

The combined golf bag and collapsible golf cart 10 comprises a golf bag assembly 12 for holding various golf clubs and supplies. A golf cart assembly 14 is permanently built into the golf bag assembly 12. A structure 16 is for moving the golf cart assembly 12 from a retracted position in which the golf cart assembly 12 nests against the golf bag assembly to an extended position away from the golf bag assembly, so that the golf bag assembly 12 can be transported by the golf cart assembly 14 along the ground.

The golf bag assembly 12 is a semi-rigid tubular shell 18 having a closed bottom end 20 and an open top end 22 to receive the golf clubs therein. A plurality of side pockets 24 receive the golf supplies therein.

A lower rear part of the golf bag assembly 12 is slanted at 26 to make a minimum contact with the ground, while being transported by the golf cart assembly 14 when in the extended position. A support leg 28 is pivotally mounted at 30 to a lower front part, to help stabilize the golf bag assembly 12 when in a free standing position and the golf cart assembly 14 is in the retracted position.

The golf cart assembly 14 includes a rigid elongated sleeve member 32 longitudinally embedded into a rear part of the golf bag assembly 12. A spring loaded hinge plate 34 is connected through the rear part of the golf bag assembly 12 to the middle of the rigid elongated sleeve member 32. A pair of tubular wheel mechanisms 36 are provided, with each pivotally connected at an upper end to the spring loaded hinge plate 34. The spring loaded hinge plate 34 will normally keep the tubular wheel mechanisms 36 nested against the golf bag assembly 12 in the retracted position. A handlebar 38 is hollow and has a pull handle 40 on a top end, whereby the handlebar 38 slides vertically within the rigid elongated sleeve member 32.

Each tubular wheel mechanism 36 consists of an upper leg channel 42. A curved lower leg plate 44 is pivotally connected to a lower end of the upper leg channel 42. A wheel 46 is mounted in a rotatable manner to the curved lower leg plate 44.

The upper leg channel 42 contains an upper pivot joint disc 48 at the upper end. A lower pivot joint disc 50 is at the lower end. A pair of linkage bars 52 extend between the upper pivot joint disc 48 and the lower pivot joint disc 50. A tension spring 54 is diagonally connected between the linkage bars 52 for added support, to allow the curved lower leg plate 44 to swing into an aligned position with the upper leg channel 42.

The moving structure 16 includes a pair of upper support rods 56 pivotally connected at upper ends to an upper slide anchor 57 through an upper track 58 in the rigid elongated sleeve member 32 to the handlebar 38, and at lower ends to the tubular wheel mechanisms 36. A pair of lower support rods 60 are pivotally connected at lower ends to a lower slide anchor 61 through a lower track 62 in the rigid elongated sleeve member 32 to the handlebar 38, and at upper ends to the tubular wheel mechanisms 36. When the handlebar 38 is manually pulled upwardly by a hand 64 grasping the pull handle 40, the tubular wheel mechanisms 36 will move upward to a ninety degree angle and outwardly from the golf bar assembly 12 to a forty five degree angle, so that the tubular wheel mechanisms 36 will stay parallel to the golf bag assembly 12.

A locking mechanism 66 in a lower portion of the handlebar 38 engages with the rigid elongated sleeve member 32. The locking mechanism 66 will retain the tubular wheel mechanisms 36 in the retracted position and in the extended position. A lock release ring 68 is in the pull handle 40 of the handlebar 38. An elongated cable 70 extends from the lock release ring 66 to the locking mechanism 64. A finger 72 of the hand 64 grasping the pull handle 40 can pull the lock release ring 68 to disengage the locking mechanism 66, so that it can go from the retracted position to the extended position.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combined golf bag and collapsible golf cart comprising:

a) a golf bag assembly for holding various golf clubs and supplies;

b) a golf cart assembly permanently built into said golf bag assembly;

c) a means for moving said golf cart assembly from a retracted position in which said golf cart assembly nests against said golf bag assembly, to an extended position away from said golf bag assembly, so that said golf bag assembly can be transported by said golf cart assembly along the ground;

d) said golf cart assembly including a rigid elongated sleeve member longitudinally embedded into a rear part of said golf bag assembly, a hinge plate connected through the rear part of said golf bag assembly to a middle of said rigid elongated sleeve member, a pair of tubular wheel mechanisms, each pivotally connected at an upper end to said hinge plate, so that said hinge plate will normally keep said tubular wheel mechanisms nested against said golf bag assembly in the retracted position, and, a handlebar being hollow and having a pull handle on a top end, whereby said handlebar slides vertically within said rigid elongated sleeve member;

e) each said tubular wheel mechanism including an upper leg channel, a curved lower leg plate pivotally connected to a lower end of said upper leg channel, and a wheel mounted in a rotatable manner to said curved lower leg plate; and, f) each said upper leg channel including an upper pivot joint disc at at an upper end, a lower pivot joint disc at a lower end, a pair of linkage bars extending between said discs, and a tension spring diagonally connected between said linkage bars for added support to allow said curved lower leg plate to swing into an aligned position with said upper leg channel.

2. A combined golf bag and collapsible golf cart as recited in claim 1, wherein said golf bag assembly is a semi-rigid tubular shell having a closed bottom end and an open top end to receive the golf clubs therein.

3. A combined golf bag and collapsible golf cart as recited in claim 1, wherein said golf bag assembly includes a plurality of side pockets to receive the golf supplies therein.

4. A combined golf bag and collapsible golf cart as recited in claim 1, wherein a lower rear part of said golf bag assembly is slanted to make a minimum contact with the ground, while being transported by said golf cart assembly when in the extended position.

5. A combined golf bag and collapsible golf cart as recited in claim 1, wherein said golf bag assembly further includes a support leg pivotally mounted to a lower front part, to help stabilize said golf bag assembly when in a free standing position and said golf cart assembly is in the retracted position.

6. A combined golf bag and collapsible golf cart comprising:

a) a golf bag assembly for holding various golf clubs and supplies;

b) a golf cart assembly permanently built into said golf bag assembly;

c) a means for moving said golf cart assembly from a retracted position in which said golf cart assembly nests against said golf bag assembly, to an extended position away from said golf bag assembly, so that said golf bag assembly can be transported by said golf cart assembly along the ground;

d) said golf cart assembly including a rigid elongated sleeve member longitudinally embedded into a rear part of said golf bag assembly, a hinge plate connected through the rear part of said golf bag assembly to a middle of said rigid elongated sleeve member, a pair of tubular wheel mechanisms, each pivotally connected at an upper end to said hinge plate, so that said hinge plate will normally keep said tubular wheel mechanisms nested against said golf bag assembly in the retracted position, and, a handlebar being hollow and having a pull handle on a top end, whereby said handlebar slides vertically within said rigid elongated sleeve member; and, e) said means for moving including a pair of upper support rods pivotally connected at upper ends through an upper track in said rigid elongated sleeve member to said handlebar, and at lower ends to said tubular wheel mechanisms, and a pair of lower support rods pivotally connected at lower ends through a lower track in said rigid elongated sleeve member to said handlebar, and at upper ends to said tubular wheel mechanisms, so that when said handlebar is manually pulled upwardly by a hand grasping said pull handle, said tubular wheel mechanisms will move upward to a ninety-degree angle, and outwardly to a forty-five degree angle.

7. A combined golf bag and collapsible golf cart comprising:

a) a golf bag assembly for holding various golf clubs and supplies, wherein said golf bag assembly is a semi-rigid tubular shell having a closed bottom end, and an open top end to receive the golf clubs, b) a golf cart assembly permanently built into said golf bag assembly, c) a means for moving said golf cart assembly from a retracted position in which it nests against said golf bag assembly, to an extended position away from said golf bag assembly, so that the latter can be transported by said golf cart assembly along the ground;

d) said golf bag assembly includes a plurality of side pockets to receive golf supplies, a lower rear part of said golf bag assembly is slanted to make a minimum contact with the ground, while being transported by said golf cart assembly when in the extended position, and said golf bag assembly further includes a support leg pivotally mounted to a lower front part to help stabilize said golf bag assembly when in a free-standing position, and said golf cart assembly is in the retracted position;

e) a rigid elongated sleeve member longitudinally embedded into a rear part of said golf bag assembly, a hinge plate connected through the rear part of said bag assembly to a middle of said rigid elongated sleeve member, a pair of tubular wheel mechanisms, each pivotally connected at an upper end to said hinge plate, so that said hinge plate will normally keep said tubular wheel mechanisms nested against said golf bag assembly in the retracted position, and a handlebar being hollow, and having a pull handle on a top end, whereby said handlebar slides vertically within said rigid elongated sleeve member;

f) each said tubular wheel mechanism including an upper leg channel, a curved lower leg plate pivotally connected to a lower end of said upper leg channel, and a wheel mounted in a rotatable manner to said curved lower leg plate; and, g) each upper leg channel includes an upper pivot joint disc at an upper end, a lower pivot joint disc at a lower end, a pair of linkage bars extending between said discs, and a tension spring diagonally connected between said linkage bars for added support to allow said curved lower leg plate to swing into an aligned position with said upper leg channel.

8. A combined golf bag and collapsible golf cart as recited in claim 7, wherein said moving means includes:

a) a pair of upper support rods pivotally connected at upper ends through an upper track in said rigid elongated sleeve member to said handlebar and at lower ends to said tubular wheel mechanisms; and b) a pair of lower support rods pivotally connected at lower ends through a lower track in said rigid elongated sleeve member to said handlebar and at upper ends to said tubular wheel mechanisms, so that when said handlebar is manually pulled upwardly by a hand grasping said pull handle, said tubular wheel mechanisms will move upward to a ninety degree angle and outwardly from said golf bag assembly to a forty five degree angle, so that said tubular wheel mechanisms will stay parallel to said golf bag assembly.

* * * * *